US006495801B2

(12) United States Patent
Fromson et al.

(10) Patent No.: US 6,495,801 B2
(45) Date of Patent: Dec. 17, 2002

(54) METHOD AND APPARATUS FOR HEATING PRINTING PLATES

(75) Inventors: Howard A. Fromson, 43 Main St., Stonington, CT (US) 06378; William J. Rozell, Vernon, CT (US); Paul C. Schunk, East Longmeadow, MA (US); Russell R. Thomas, West Springfield, MA (US)

(73) Assignee: Howard A. Fromson, Stonington, CT (US)

( * ) Notice: Subject to any disclaimer, the term of this patent is extended or adjusted under 35 U.S.C. 154(b) by 0 days.

(21) Appl. No.: 09/826,077

(22) Filed: Apr. 4, 2001

(65) Prior Publication Data

US 2002/0144991 A1 Oct. 10, 2002

(51) Int. Cl.[7] ..... G03D 13/00; F27B 9/24

(52) U.S. Cl. ..... 219/388; 219/216; 396/575

(58) Field of Search ..... 219/388, 399, 219/409, 216; 430/302, 309, 349, 350; 396/575

(56) References Cited

U.S. PATENT DOCUMENTS 4,935,071 A * 6/1990 Viles et al. ..... 148/657
5,051,338 A * 9/1991 Kato et al. ..... 430/296
5,491,046 A * 2/1996 DeBoer et al. ..... 430/302
5,669,032 A * 9/1997 Islam et al. ..... 219/216
5,822,641 A * 10/1998 Furukawa ..... 396/575
5,980,128 A * 11/1999 Verlinden et al. ..... 396/575
6,190,841 B1 * 2/2001 Kihara et al. ..... 430/326
6,323,462 B1 * 11/2001 Strand ..... 219/388
6,368,776 B1 * 4/2002 Harada et al. ..... 219/388

FOREIGN PATENT DOCUMENTS

WO 01/29620 * 4/2001

* cited by examiner

*Primary Examiner*—Joseph Pelham
(74) *Attorney, Agent, or Firm*—Alix, Yale & Ristas, LLP

(57) ABSTRACT

Certain types of lithographic printing plates are activated by preheating while certain other types are post heated to harden the coating. A platen having a large mass compared to the mass of a printing plate is heated and maintained in the exact temperature range to which the printing plate is to be heated. A printing plate is brought into heat exchange contact with the platen for the period of time required to heat the printing plate to the temperature of the platen. The printing plate may be heated while resting in a fixed position on the platen or while the printing plate is carried over the platen by a continuous thin metal conveyor belt in intimate contact with both the platen and printing plate.

14 Claims, 6 Drawing Sheets

METHOD AND APPARATUS FOR HEATING PRINTING PLATES

BACKGROUND OF THE INVENTION

The present invention relates to the heating of digitally imageable lithographic printing plates and more particularly to the preheating of a plate in preparation for imaging or to the post heating of a plate after imaging.

Present thermal printing plate imaging technology requires the preheating of certain types of plates prior to imaging while post heating or baking is used with other types of plates after imaging. The preheating step is required for those plates requiring heating to activate the plate so that it is responsive to the laser imaging process. An example is a negative working plate where the preheat serves to form a Bronsted acid in the coating, thereby making the coating imageable by subsequent exposure with a thermal laser which insolubilizes the coating in those areas struck by the laser. Post baking is often used to further harden a coating for improved run length. This post baking process is very well known for positive-working plates with coatings containing phenolic resins. In both situations, the plate must be heated to a specific temperature for the process to work successfully.

The present technique for heating such plates uses convection ovens with the oven being set at some temperature well above the desired plate temperature. The expectation is that the dynamics of the heat transfer process can be controlled such that the plate achieves and is maintained at the desired temperature as it is conveyed through the oven. There are several drawbacks to this technique:

1. The heat transfer is non-uniform across the plate. As the plate travels through the oven, different areas of the plate are subjected to different degrees of heating depending on relative proximity to the heat source and airflow dynamics. The leading edge of the plate enters the oven at ambient temperature, whereas the trailing edge is preheated by conduction within the sheet prior to entering the oven. Obviously both edges have the same dwell within the oven.
2. There is the potential to overheat or to underheat the plate if any variable in the heating process changes. For example, if the initial plate temperature or ambient air temperature varies, the resultant temperature of the heated plate in the oven will give rise to a different end point temperature.
3. The oven set point needs to be varied for different size plates or different plate thicknesses. The mass that needs to be brought to the desired temperature will be different for 0.008" and 0.012" plates.
4. There are substantial heat losses to the room environment. This necessitates a larger investment in energy costs to maintain both the oven temperature and the room temperature.

When the plates are not brought to the correct temperature, performance problems arise. For example, for negative-working plates, if insufficient Bronsted acid is formed due to underheating, the plate will not respond properly to the imaging laser radiation. This may be localized due to non-uniform heating that can result in hot or cold spots on the plate. Conversely, if the preheat is too high, it may begin to convert the coating to an insolubilized state, thus causing toning in non-laser imaged areas.

For the positive-working plates with a post-baking process, underheating results in insufficient hardening of the coating. The coating will then suffer from premature wear, and the press run length will be shortened. The convection ovens are often run at settings near the annealing point of the aluminum. Hot spots or overheating may result in distortion of the aluminum sheet.

SUMMARY OF THE INVENTION

The object of the present invention is to provide apparatus and a method for heating a printing plate either before or after imaging whereby precise plate temperature control can be achieved. More particularly, a platen of sufficient mass and heat capacity is heated and maintained at the desired printing plate temperature. The printing plates, which are of low mass compared to the platen, are loaded onto and maintained in heat transfer contact with the platen for the period of time required to heat the printing plates to the temperature of the platen. The printing plates are then unloaded from the platen and processed according to the type of plate.

DESCRIPTION OF THE PREFERRED EMBODIMENTS

Figure 1:
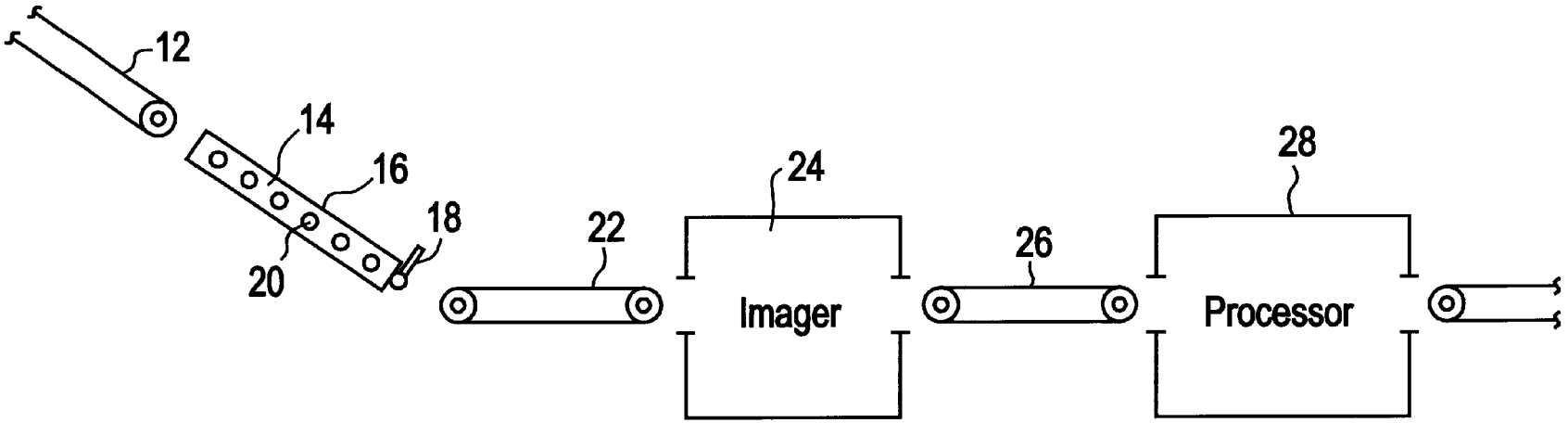
FIG. 1 is a schematic process diagram generally illustrating an imaging process line with the heating platen of the present invention for a preheating operation.

FIG. 1 of the drawings relates to a preheating operation for printing plates which require heating to activate the coating on the plate so that the coating is responsive to the digital laser imaging process. As previously indicated, an example is a negative-working printing plate where the laser renders the coating insoluble in the imaged areas. A specific example is where the preheat serves to form a Bronsted acid in the coating which makes the coating imageable by the subsequent exposure to thermal laser radiation. In this FIG. 1, individual lithographic printing plates are periodically fed by the conveyor 12 onto the heated platen 14. The individually loaded plates slide down the sloped top surface 16 of the platen by gravity and come to rest against the plate stops 18.

The platen 14, which will be described in more detail later, is provided with a plurality of channels 20 extending therethrough parallel to the top surface 16 and containing electrical elements for heating the platen. After the printing plate has been heated to the required activating temperature on the platen, the stops are released and the printing plate slides off of the platen onto the conveyor 22 and is delivered to the conventional digital laser imager generally indicated at 24. The imaged plate is then delivered by the conveyor 26 to the processor 28 where the non-laser imaged areas are removed leaving the ink-receptive coating.

Figure 2:
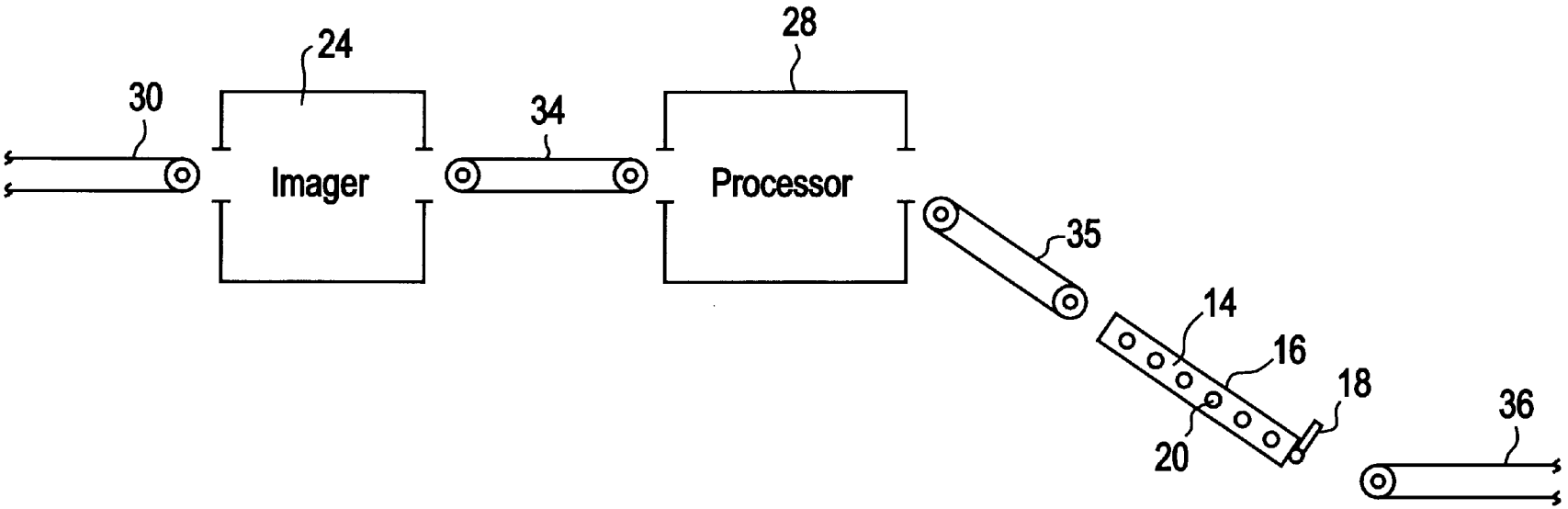
FIG. 2 is a similar process diagram for a post-heating operation.

FIG. 2 relates to the post-heating operation for the hardening of the positive imaged coating as previously described. In this operation, a plate is fed by the conveyor 30 into the digital laser imager 24 and then fed by the conveyor 34 into the processor 28. From the processor 28, the plate containing the positive polymer image is fed by the conveyor 35 onto the heated platen 14, heated to the required temperature and carried away as a finished printing plate on the conveyor 36.

Figure 3:
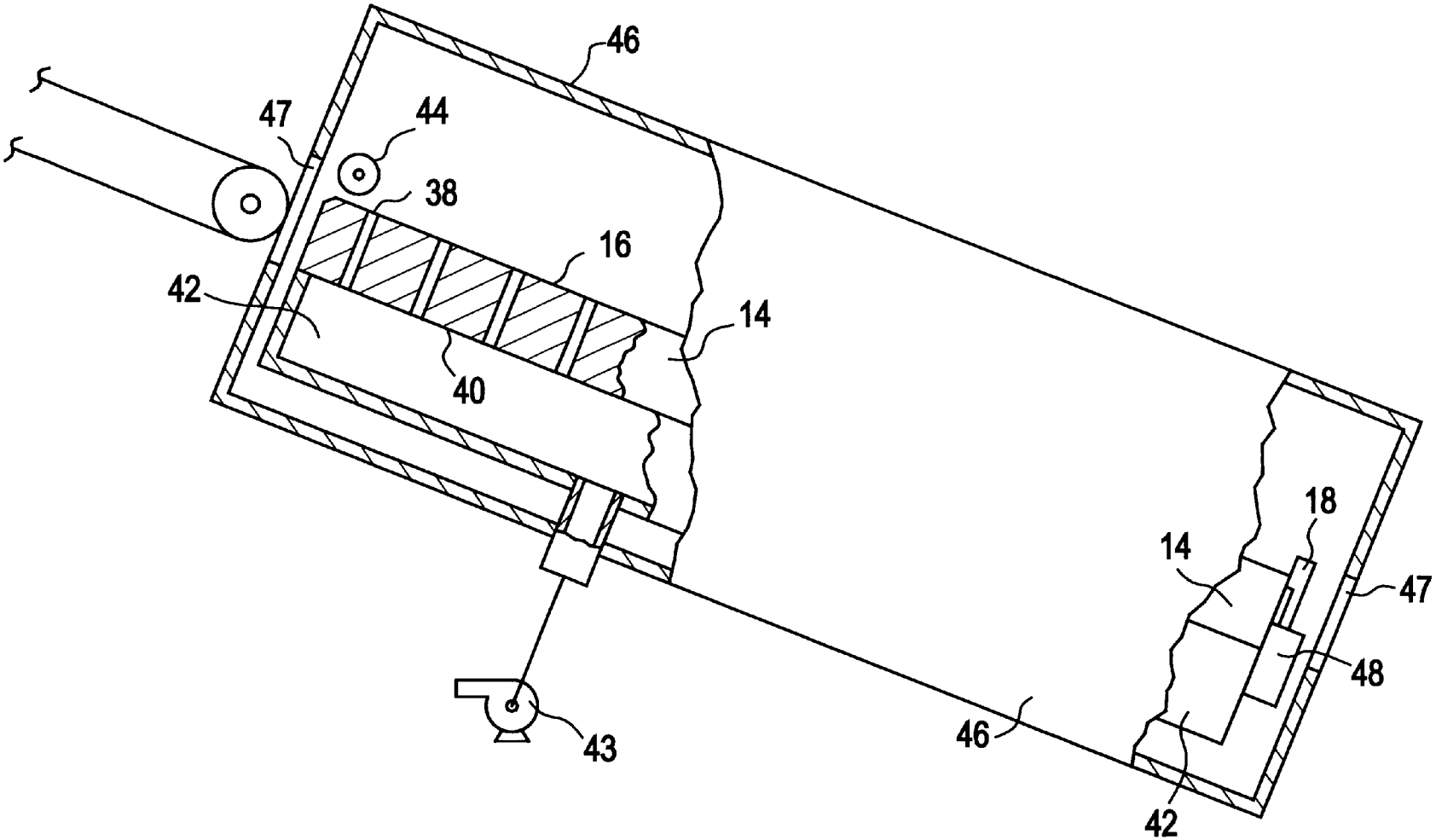
FIGS. 3 and 4 are more detailed drawings of various features of the platen and associated equipment.

The platen, as seen in more detail in FIG. 3, contains a plurality of small holes 38 extending through the platen from the top surface 16 to the bottom surface 40. On the bottom surface 40 of the platen is a vacuum chamber 42 connected to the vacuum pump 43. The vacuum which is drawn through the holes 38 pulls the printing plate into intimate heat exchange contact against the top surface 16 of the platen 14. The spacing of the holes 38 is selected to provide this intimate contact over the entire area of the printing plate. Means are also provided, such as the roller 44, to help guide the plate onto the platen so that it slides down the platen in full contact with the surface 16. In order to assure the maintenance of the temperature and prevent the dissipation of heat to the surroundings, the platen arrangement includes the housing 46 which may be insulated. Openings 47 are provided for the printing plate to enter and exit. This FIG. 3 also shows one of the stops 18 including a solenoid 48 for lowering and raising the stop. The solenoid 48 as well as the vacuum pump 43 are connected to the control unit discussed later to synchronize the lowering of the stops and turning of the vacuum to permit the plate to slide off of the platen.

Figure 4:
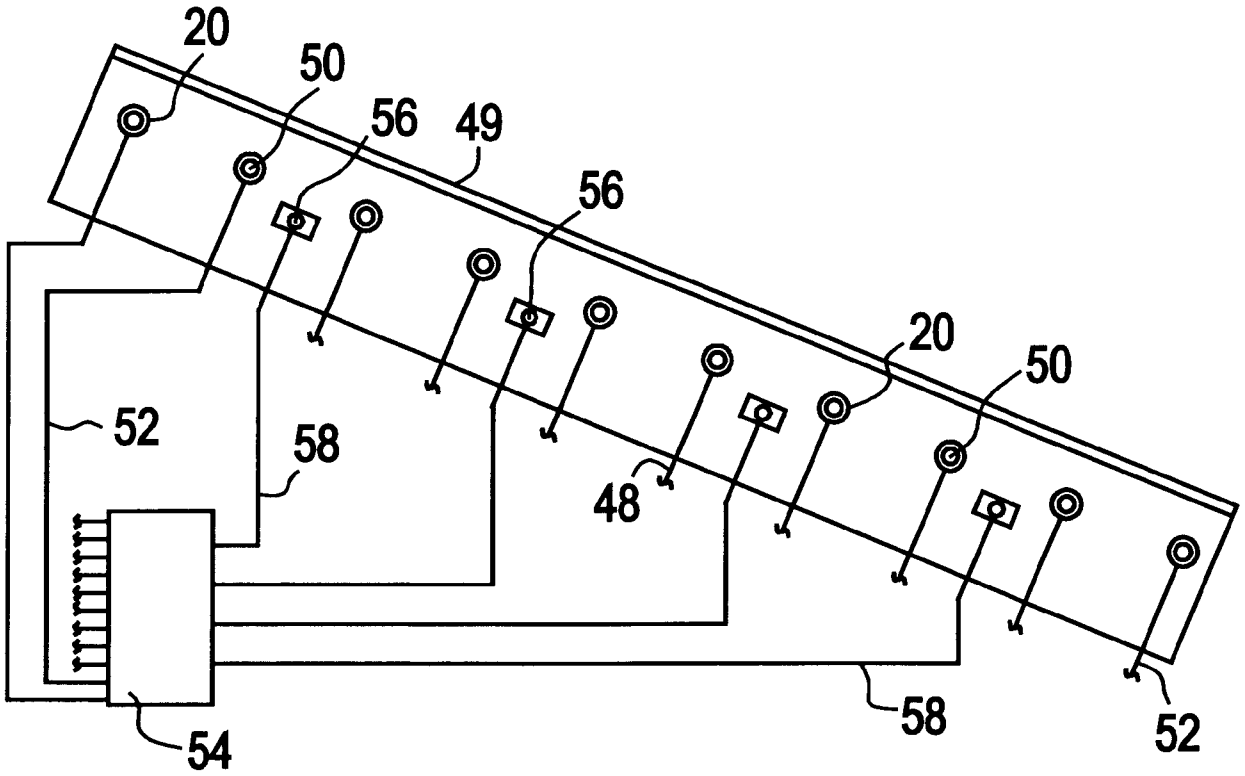

As shown in FIG. 4 which includes features not shown in FIG. 3 for purposes of clarity, the top surface 16 of the platen is preferably coated at 49 to assure a smooth surface. One reason is to provide a surface which permits the plates to slide down the slope easily. The other reason is to assure a flat surface for the intimate heat exchange contact with the plate. The coating may, for example, be a chrome plating or a Teflon coating.

The platen is provided with a plurality of channels 20 extending therethrough parallel to the top surface 16. These channels 20 contain electrical heating elements 50. These electrical heating elements 50 are connected by the wiring 52 to the control unit 54 which may control each of the heating elements individually or in selected groups. The platen is also provided with temperature sensing devices 56 such as thermocouples. These sensors 56 are also connected individually to the control unit 54 by the wires 58. These sensors are connected in the control unit 54 to activate and deactivate the adjacent heating elements to accurately control the temperature over the entire platen. The temperature of the platen and the plate are usually controlled to ±2 to 5° F. and preferably to 1 to 2° F. Since the platen, which is perhaps 1 or 2 inches thick, has such a large mass as compared to the mass of the plate, which is usually 0.008 to 0.012 inches thick, loading the plate onto the platen will have a negligible effect on the platen temperature and the plate will rapidly heat to the platen temperature. The heating of the plate only takes about 20 to 30 seconds.

Figure 5:
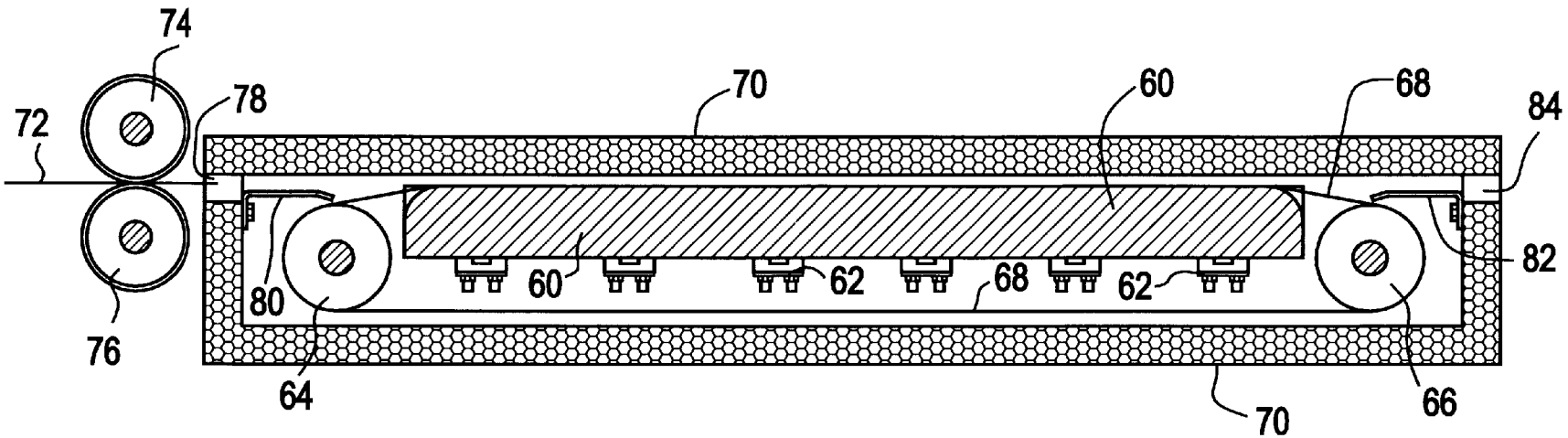
FIG. 5 is a cross-section view of another embodiment of the invention employing a conveyor for transporting the printing plate over the heated platen.
Figure 6:
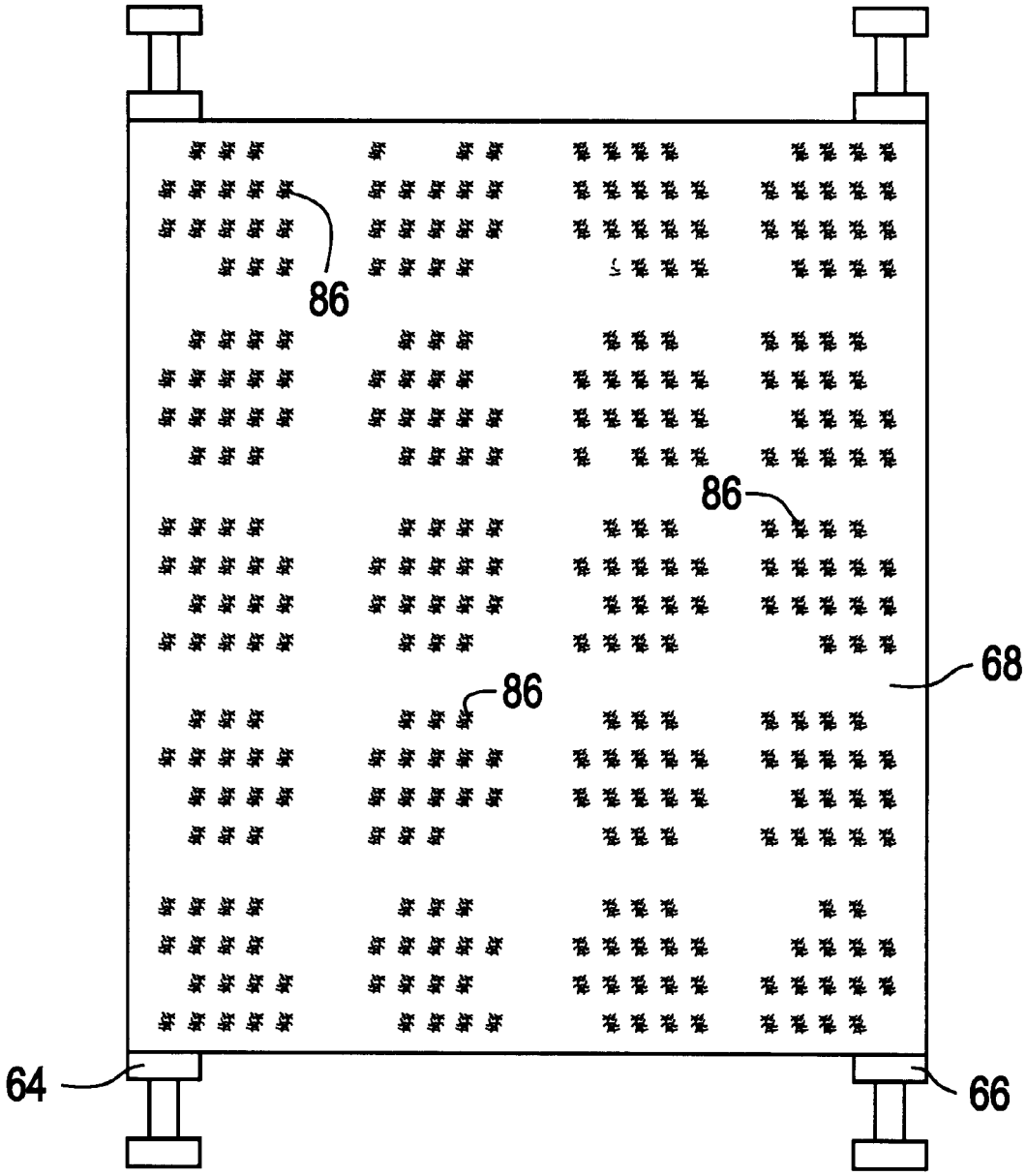
FIG. 6 is a plan view of the conveyor of FIG. 5.

Another embodiment of the present invention is shown in FIGS. 5 and 6. In this embodiment, the printing plate being heated is moved across the platen as it is being heated rather than having the plate stationary on the platen as in the previously discussed embodiment. Referring to FIG. 5, there is a platen 60 shown in cross-section. In this embodiment, the platen can be horizontal as illustrated since the plate will be conveyed across the platen as will become apparent. Also, in this embodiment, the electrical heating elements are illustrated as strip heaters 62 attached at intervals and extending across the bottom of the platen. The specific type and location of the electrical heating elements is a matter of design choice as long as the platen can be evenly heated and the temperature controlled. Temperature sensing devices and a control unit are not shown in this FIG. 5 but they would be included just as in the previous embodiment.

The printing plate in this FIG. 5 embodiment is carried across the platen 60 by means of a heat conductive belt conveyor which comprises the conveyor drive rollers 64 and 66 and a continuous thin metal conveyor belt 68. The belt 68 is metal and is thin in order to effectively transfer the heat from the platen through the belt to the plate. The preferred belt material is stainless steel with a thickness of about 0.005 inches.

The platen and belt conveyor are surrounded by the enclosure 70 which is a heat shield structure formed from or including insulation to retain the heat and maintain the proper temperature. For example, the enclosure 70 can be one-inch thick calcium silicate insulation board. The printing plate 72 is fed by the feed rollers 74 and 76 through the feed opening 78 in the enclosure 70 onto the feed shelf 80. This feed shelf 80 directs the plate onto the belt 68 for transport across the heated platen 60. The heated plate is then guided by the discharge shelf 82 out through the discharge opening 84 in the enclosure 70.

If it is required or desirable to provide means for holding the belt firmly in contact with the platen and/or the plate firmly in contact with the belt, the platen 60 can have vacuum holes and a vacuum chamber, such as shown in the FIG. 3 embodiment. Likewise, the belt 68 can have holes 86 as shown in FIG. 6 to apply the vacuum through the belt to the plate. Also, if it is desired or necessary to assure the free movement of the belt across the surface of the platen, the platen can be coated such as with Teflon.

The heating of the plate by conduction according to the present invention is a fast and energy efficient heat transfer process. Since the platen is maintained at the desired plate temperature, there is no underheating problem as long as the plate is given sufficient time in contact with the platen. Likewise, there is no overheating problem since the maximum temperature of the plate cannot exceed the platen temperature no matter how long the plate remains on the platen. Since the mass of the platen is large compared to the plate, the impact of varied plate sizes or thicknesses has a negligible impact on the ultimate plate temperature. Even if a small region of the plate, such as a plate corner, is not in intimate contact with the platen, the high heat conductivity of the plate itself will rapidly elevate the temperature of that area to the set point. An advantage of one embodiment of the invention is that the heating is static with the plate in a fixed position. The result is that the heating means of that embodiment of the invention requires considerably less space.

What is claimed is:

1. A processing line for imaging a lithographic printing plate including an imager for imaging said plate and a processor for processing said imaged plate, said processing line further including heating apparatus for heating said plate, said heating apparatus comprising:

a. a platen having a smooth flat upper surface;

b. means for feeding said plate directly onto said platen in contact with said upper surface;

c. movable stops for stopping said plate on said platen and for releasing said plate from said platen;

d. heating means for heating said platen to a desired temperature;

e. means for controlling said heating means adapted to control said platen temperature to said desired temperature; and f. means for holding said plate in intimate contact with said upper surface of said platen.

2. A processing line as recited in claim 1 wherein said heating apparatus precedes said imager and includes means for conveying said plate from said heating apparatus to said imager.

3. A processing line as recited in claim 1 wherein said heating apparatus follows said processor.

4. A processing line as recited in claim 1 wherein said platen is sloped at an angle wherein said angle is sufficient to cause said plate to slide down said upper surface of said sloped platen.

5. A processing line as recited in claim 4 wherein said means for holding said plate in intimate contact with said upper surface of said platen includes holes extending through said platen from said upper surface to the bottom surface and means for drawing a vacuum through said holes.

6. A processing line as recited in claim 5 wherein said means for drawing a vacuum includes a vacuum chamber on said bottom surface of said platen.

7. A processing line as recited in claim 6 and further including means for releasing said vacuum and moving said stops for releasing said plate from said platen.

8. A processing line as recited in claim 1 wherein said heating means comprises electrical heating means.

9. A processing line as recited in claim 1 wherein said heating means comprises a plurality of electrical heating means.

10. A processing line as recited in claim 9 wherein said plurality of electrical heating means extend through channels in said platen extending parallel to said upper surface.

11. A processing line as recited in claim 1 wherein said heating means are attached to the bottom surface of said platen.

12. A processing line as recited in claim 11 wherein heating means comprises electrical heating means.

13. A processing line as recited in claim 1 and further including temperature measuring means for measuring the temperature of said platen connected to said means for controlling said heating means.

14. A processing line for imaging a lithographic printing plate including an imager for imaging said plate and a processor for processing said imaged plate, said processing line further including heating apparatus for heating said plate, said heating apparatus comprising:

a. a platen having a flat upper surface;

b. means for feeding a plate into heat exchange contact with said upper surface;

c. means for discharging said plate from said platen;

d. heating means attached to said platen for heating said platen to a desired temperature; and e. means for controlling said heating means adapted to control said platen temperature to said desired temperature.

* * * * *

UNITED STATES PATENT AND TRADEMARK OFFICE

CERTIFICATE OF CORRECTION

PATENT NO. : 6,495,801 B2
DATED : December 17, 2002
INVENTOR(S) : Fromson et al.

It is certified that error appears in the above-identified patent and that said Letters Patent is hereby corrected as shown below:

Column 6,
Line 17, after "surface" delete ";" and insert -- comprising a continuous heat conductive conveyor belt adapted to carry a plate and being movable along said upper surface in heat exchange contact with said platen; --.
Line 20, after ";" delete "and".
Line 23, before "." insert -- ; and f. vacuum means for holding said belt in contact with said upper surface and for holding said plate in contact with said belt --

Signed and Sealed this

Twentieth Day of April, 2004

JON W. DUDAS
*Acting Director of the United States Patent and Trademark Office*